US007148612B2

(12) United States Patent
Pino et al.

(10) Patent No.: US 7,148,612 B2
(45) Date of Patent: Dec. 12, 2006

(54) SPARK PLUG WITH INCLINED ELECTRODE SPARK SURFACES

(75) Inventors: Alessandro Pino, Boughton (GB); John Anthony Burrows, Northwich (GB)

(73) Assignee: Federal-Mogul Ignition (UK) Limited, Merseyside (GB)

( * ) Notice: Subject to any disclaimer, the term of this patent is extended or adjusted under 35 U.S.C. 154(b) by 310 days.

(21) Appl. No.: 10/490,131

(22) PCT Filed: Sep. 25, 2002

(86) PCT No.: PCT/GB02/04348

§ 371 (c)(1),
(2), (4) Date: Mar. 18, 2004

(87) PCT Pub. No.: WO03/028178

PCT Pub. Date: Apr. 3, 2003

(65) Prior Publication Data

US 2004/0239222 A1 Dec. 2, 2004

(30) Foreign Application Priority Data

Sep. 26, 2001 (GB) ..... 0123102.6

(51) Int. Cl.
*H01T 13/20* (2006.01)

(52) U.S. Cl. ..... 313/141; 313/142

(58) Field of Classification Search ..... 313/141, 313/142

See application file for complete search history.

(56) References Cited

U.S. PATENT DOCUMENTS

| | | | | |
|---|---|---|---|---|
| 4,329,615 A | | 5/1982 | Tanaka et al. | |
| 4,841,925 A | * | 6/1989 | Ward | 123/143 B |
| 5,535,726 A | | 7/1996 | Wilmot et al. | |
| 5,612,586 A | | 3/1997 | Benedikt et al. | |
| 5,955,827 A | | 9/1999 | Short | |
| 6,166,480 A | * | 12/2000 | Ishida et al. | 313/141 |
| 6,470,845 B1 | | 10/2002 | Kanao | |
| 6,603,246 B1 | | 8/2003 | Hori | |
| 2001/0015602 A1 | | 8/2001 | Hori | |

FOREIGN PATENT DOCUMENTS

| | | |
|---|---|---|
| EP | 0164613 | 5/1985 |
| EP | 0 895 327 | 3/1999 |
| GB | 2 184 484 | 6/1987 |
| GB | 2 189 545 | 10/1987 |
| JP | 4154069 | 5/1992 |
| JP | 05-074549 | 3/1993 |
| JP | 2000252039 | 9/2000 |

* cited by examiner

*Primary Examiner*—Joseph Williams
*Assistant Examiner*—Matt Hodges
(74) *Attorney, Agent, or Firm*—Reising, Ethington, Barnes, Kisselle, P.C.

(57) ABSTRACT

A spark plug comprises an electrically-insulating sleeve (12) extending along a central axis (14) of the plug, a first electrode (16) having a tip (20), an electrically-conducting shell (22), and a second electrode (26) mounted on the shell, the second electrode having a tip (28). The tips (20 and 28) have spark surfaces (30, 32) which define a spark gap (34) of the plug. The spark surfaces (30, 32) are inclined at different angles (θ1, θ2) relative to a plane (36, 38) extending normally of said central axis (14) of the plug so that said spark gap (34) varies in width along the length of the gap with the narrowest point (X1) of the gap being further from the connection between the second electrode (26) and the shell (22) than the other end of the gap.

6 Claims, 3 Drawing Sheets

SPARK PLUG WITH INCLINED ELECTRODE SPARK SURFACES

TECHNICAL FIELD

This invention is concerned with a spark plug for use in providing an ignition spark to ignite the fuel of an internal combustion engine.

BACKGROUND OF THE INVENTION

A typical conventional spark plug comprises an electrically-insulating sleeve which extends along a central axis of the plug. Such sleeves are made of ceramic material, usually alumina. The plug also comprises a first electrode mounted within the sleeve and having a tip projecting beyond the sleeve. The electrode extends centrally within the sleeve and is electrically connected to a terminal projecting from the other end of the sleeve. The connection between the terminal and the first electrode includes a resistor also contained within the sleeve which serves to control to peak current. In the operation of the plug, a high tension lead is applied to the terminal so that a high voltage can be applied to the first electrode. The plug also comprises an electrically-conducting shell surrounding such sleeve. The shell is fixed, normally by a screw thread, into the head of an engine so that the tip of the first electrode projects into the combustion chamber of a cylinder of the engine. The plug also comprises a second electrode mounted on the shell, normally by welding, and electrically-connected to the shell. The second electrode has a tip which is positioned within the combustion chamber in opposed-relationship to the tip of the first electrode.

In the typical conventional spark plug described above, the tips of the electrodes each have a spark surface facing the spark surface of the other electrode so that the spark surfaces of the two electrodes define a spark gap of the plug. When a high voltage is applied to the first electrode, a spark jumps the spark gap and goes to ground through the second electrode, the shell, and the engine head. As it jumps the gap, the spark ignites fuel in the combustion chamber. The spark surface of the first electrode is arranged to extend in a plane which is normal to the central axis of the plug and the spark surface of the second electrode extends parallel to the spark surface of the first electrode so that the spark gap has a constant width along its length.

It has previously been proposed that the spark surfaces of the first and second electrodes should be inclined at the same angle relative to the plane extending normally of the central axis of the plug. This increases the surface area of the spark surfaces, thereby reducing the effects of wear and deposit build-up. It has also been proposed (see GB 2189545) that the spark surfaces should be made to resemble rails with inclined side surfaces sloping away from the spark surfaces and that the spark surface of the second electrode should be inclined relative to the aforementioned plane so that the spark gap varies in width with the narrowest point being nearest to the connection between the shell and the second electrode. This is said to cause the spark to be initiated at the narrowest point and advance along the gap in the direction in which it widens.

In the conventional spark plug described above the spark may cross the gap at any point along the length or across the width of the gap with the result that in some cases the spark is to some extent "masked" from the fuel mixture by the connection between the second electrode and the shell, thereby reducing the reliability of the ignition. It is an object of the present invention to overcome this disadvantage.

SUMMARY OF THE INVENTION

The invention provides a spark plug comprising an electrically-insulating sleeve extending along a central axis of the plug, a first electrode mounted within the sleeve and having a tip projecting beyond said sleeve, an electrically-conducting shell surrounding said sleeve, and a second electrode mounted on and electrically-connected to said shell, the second electrode having a tip positioned in opposed-relationship to the tip of said first electrode, the tips of said first and second electrodes each having a spark surface facing the spark surface of the other electrode, the spark surfaces of the two electrodes defining a spark gap of the plug, characterised in that the spark surfaces of the first and the second electrodes are inclined at different angles relative to a plane extending normally of said central axis of the plug so that said spark gap varies in width along the length of the gap with the narrowest point of the gap being further from the connection between the second electrode and the shell than the other end of the gap.

In a spark plug according to the invention the spark is formed at the furthest point from the connection between the second electrode and the shell. This is the optimum point for reliable ignition. Although this also concentrates the electrode wear at this point the taper of the spark gap causes the spark to form nearer to the point of connection of the second electrode and the shell but the increased "masking" of the spark is offset by the increasing length of the spark so that the ignition performance is improved in consistency. Thus, a plug according to the invention improves the performance of the plug throughout its life. The benefits of an increased spark surface area are also retained due to the inclination of the electrodes.

Preferably, in a spark plug according to the invention, the increase in the width of the spark gap along its length is at least 0.05 mm, preferably between 0.05 and 1.5 mm. For example, the increase may be between 0.1 and 0.2 mm. The narrowest width of the spark gap may be between 0.6 and 1.3 mm. For example, the narrowest width may be about 0.9 mm. The spark surface of the first electrode may be inclined at an angle between 20 degrees and 55 degrees to a plane extending normally of the central axis of the plug.

The invention may be applied to spark plugs having their electrodes formed from conventional materials or those having inserts or coatings of noble metals such as platinum or silver, ie at least one of said electrodes is at least partly formed from a noble metal.

BRIEF DESCRIPTION OF THE DRAWINGS

There now follows a detailed description, to be read with reference to the accompanying drawings, of a spark plug which is illustrative of the invention.

In the drawings.

DETAILED DESCRIPTION OF THE PREFERRED EMBODIMENT

Figure 1:
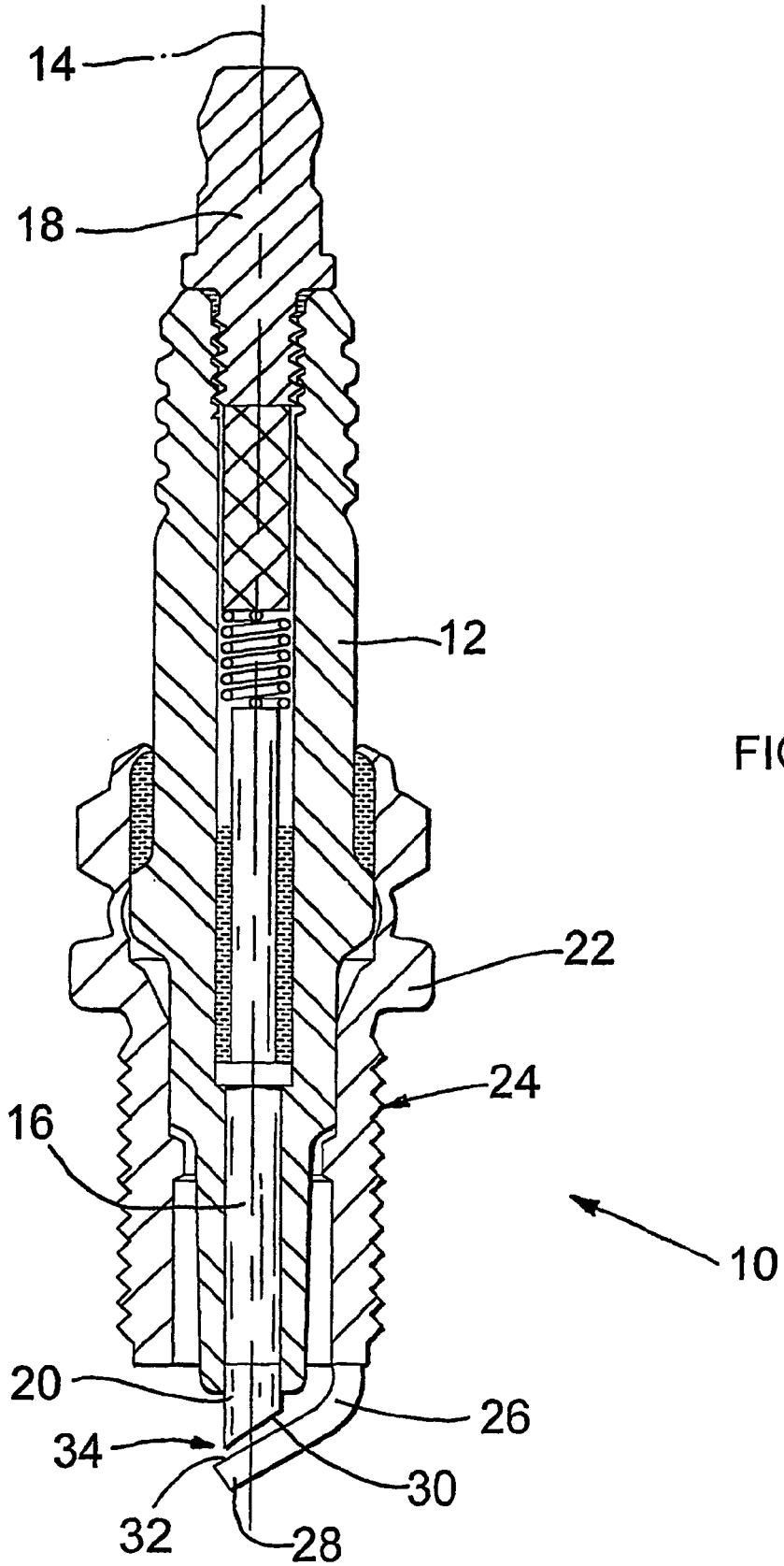
FIG. 1 is a longitudinal cross-sectional view taken through the illustrative plug.

The illustrative spark plug 10 shown in FIG. 1 is of conventional construction with the exception of the form of its electrodes. The plug 10 comprises an electrically-insulating sleeve 12 which extends along a central axis 14 of the plug 10. The sleeve 12 is formed of ceramic material and is of conventional construction. The plug 10 also comprises a first electrode 16 which is mounted within the sleeve 12 in conventional manner so that it is in electrical contact with a terminal 18 also mounted on the sleeve 12 and projecting from an upper (viewing FIG. 1) end of the sleeve. The electrode 16 is positioned centrally of the plug 10 so that it extends along the axis 14. The electrode 16 is the high voltage electrode of the plug 10 and has a tip 20 which projects beyond the sleeve 12 at the lower end of the plug 10. The plug 10 also comprises an electrically-conducting shell 22 surrounding the sleeve 12. The shell 22 is of conventional construction having a threaded area 24 by which the plug 10 is supported in the head of an engine. The plug 10 also comprises a second electrode 26 which is mounted on the shell 22 so that it is electrically-connected to the shell. Specifically, the electrode 26, which is the ground electrode of the plug 10, is welded to a lower end of the shell 22. The second electrode 26 has a tip 28 which is positioned in opposed-relationship to the tip 20 of the first electrode 16. Specifically, the electrode 26 projects from the lower end of the shell 22 extending firstly parallel to the axis 14 and then inclining inwardly so that it extends past the end of the tip 20.

The tip 20 of the first electrode 16 has a lower spark surface 30 and the tip 28 of the second electrode 26 has an upper spark surface 32. The spark surfaces 30 and 32 of the tips 20 and 28 face one another and these spark surfaces 30 and 32 define a spark gap 34 of the plug 10. When a high voltage is applied to the terminal 18, a spark can jump across the gap 34 and in doing so ignite gaseous fuel in a cylinder into which the tips 20 and 28 project.

Figure 2:
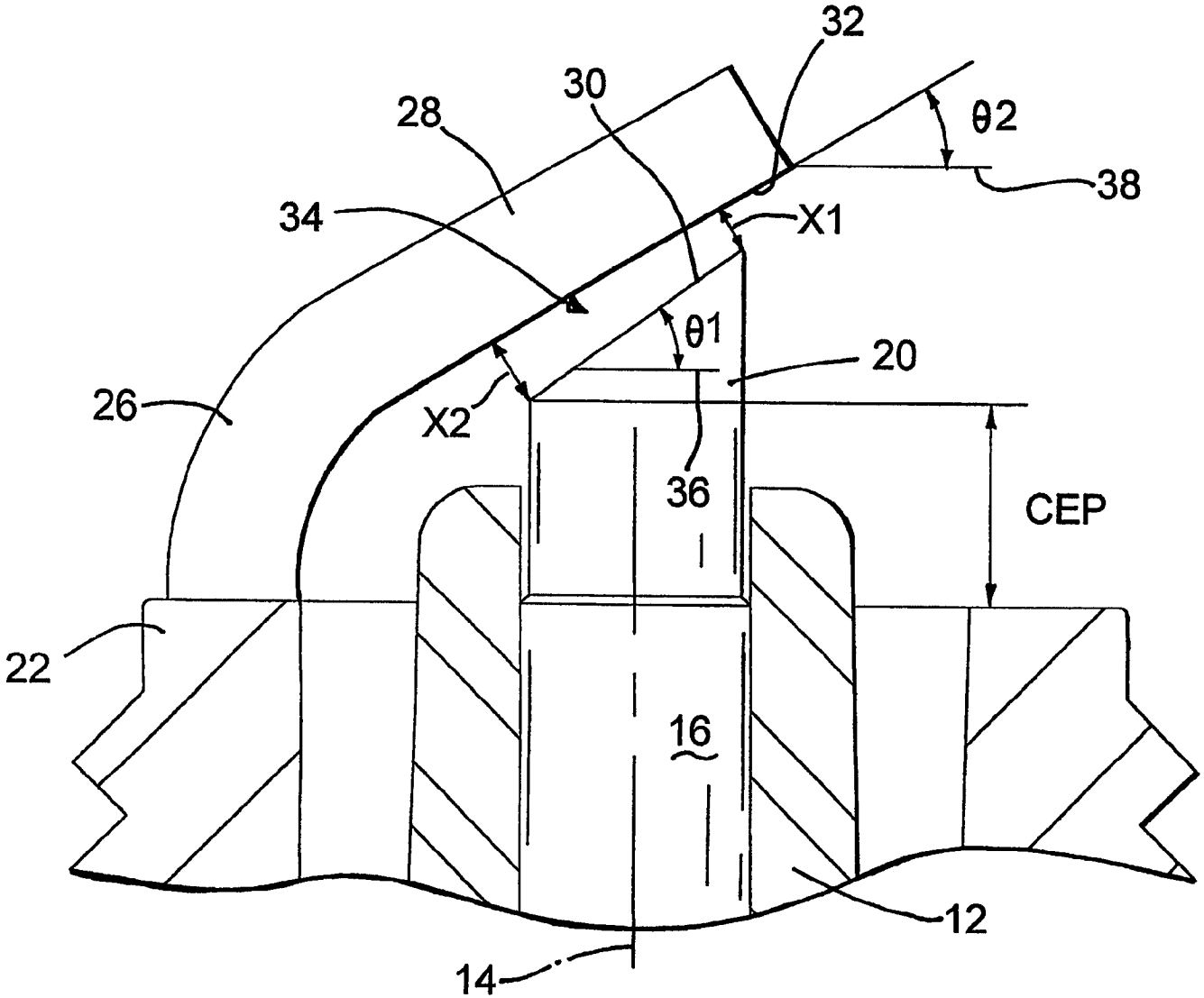
FIG. 2 is a enlarged view of the spark gap region of the illustrative plug.

FIG. 2 shows the tips 20 and 28 of the electrodes 16 and 26 in greater detail. The spark surface 30 of the tip 20 of the electrode 16 is inclined at an angle (designated θ1) relative to a plane 36 extending normally of the central axis 14 of the plug 10. Specifically θ1 is 30°. The spark surface 32 of the tip 28 of the second electrode 26 is also inclined at an angle (designated θ2) relative to a plane 38 extending normally of the axis 14. Of course, the planes 36 and 38 are parallel to one another and the angles θ1 and θ2 are measured in a longitudinal plane containing the electrode 26.

The angles θ1 and θ2 are different to one another so that the spark gap 34 varies in width along the length of the gap. The width of the gap 34 at its, narrowest point is designated X1 and occurs at the furthest point of the gap from the connection between the second electrode and the shell 22. The widest point of the gap is designated X2 and occurs at the other end of the gap 34 ie at the nearest point of the gap 34 to the connection to the electrode 26 and the shell 22. Specifically, the spacing of the tips 20 and 28 and the angle θ2 are selected so that X1 is equal to 0.9 mm and X2 is equal to 1.1 mm. FIG. 2 also shows the central electrode projection (CEP) which is the minimum projection of the tip 20 of the electrode 16 beyond the shell 22 which is in this case 2.5 mm to 2.8 mm.

In the operation of the illustrative plug 10 it is found that the spark predominately occurs in the vicinity of the narrowest point X1 so that it is in the best possible position to ensure good ignition. As the tips 20 and 28 wear, the spark position gradually moves along the gap towards the widest point X2 but the performance is improved by the increasing length of the spark.

Figure 3:
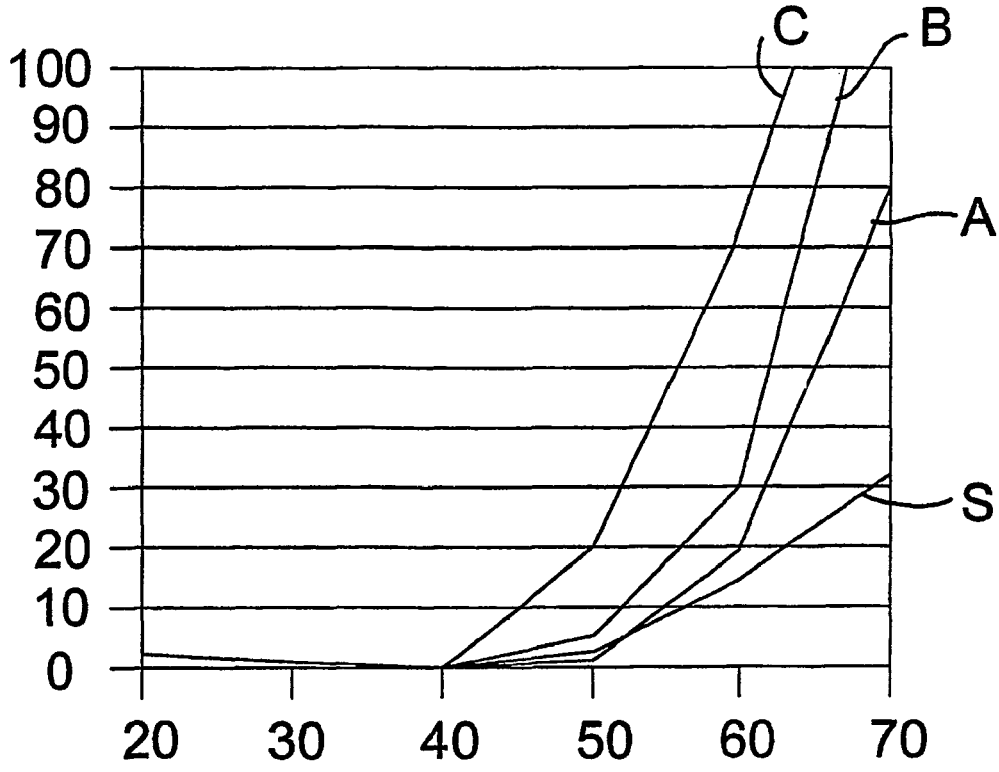
FIGS. 3 and 4 are graphical representations illustrating test results obtained using spark plugs according to the invention and conventional spark plugs.

FIG. 3 shows the results of a test programme carried out on a typical 2.0 litre 4 cylinder engine and illustrates the combustion stability of the illustrative plug 10 in comparison with 3 conventional plugs designated A, B and C. The plug A has its spark surfaces parallel to the planes 36 and 38 so that it has a constant spark gap width of 0.9 mm. Plugs B and C differ from plug A in design.

The X axis of the graph in FIG. 3 represents the timing of the spark in degrees before top dead centre and the Y axis represents in percentages the coefficient of the variation in the mean emission pressure. Thus, the graph shows the variability in combustion quality as the spark timing is moved to increasingly unfavourable positions. The smaller the number on the graph, the more stable is the operation of the engine. It can be seen from FIG. 3 that the plots A, B and C representing the performances of the standard plugs are comparable with the performance of the plug 10 (indicated by the plot S) until the spark angle reaches approximately 40 degrees but thereafter the performance of the plug 12 is significantly better, increasingly so as the angle increases. The graph of FIG. 3 clearly shows that the plug 10 maintains the best combustion behaviour of all the plugs tested. This is considered to be due to enhanced ability to ignite fuel even under difficult conditions because of the optimal placing of the spark in the cylinder relative to the electrodes of the plug.

Figure 4:
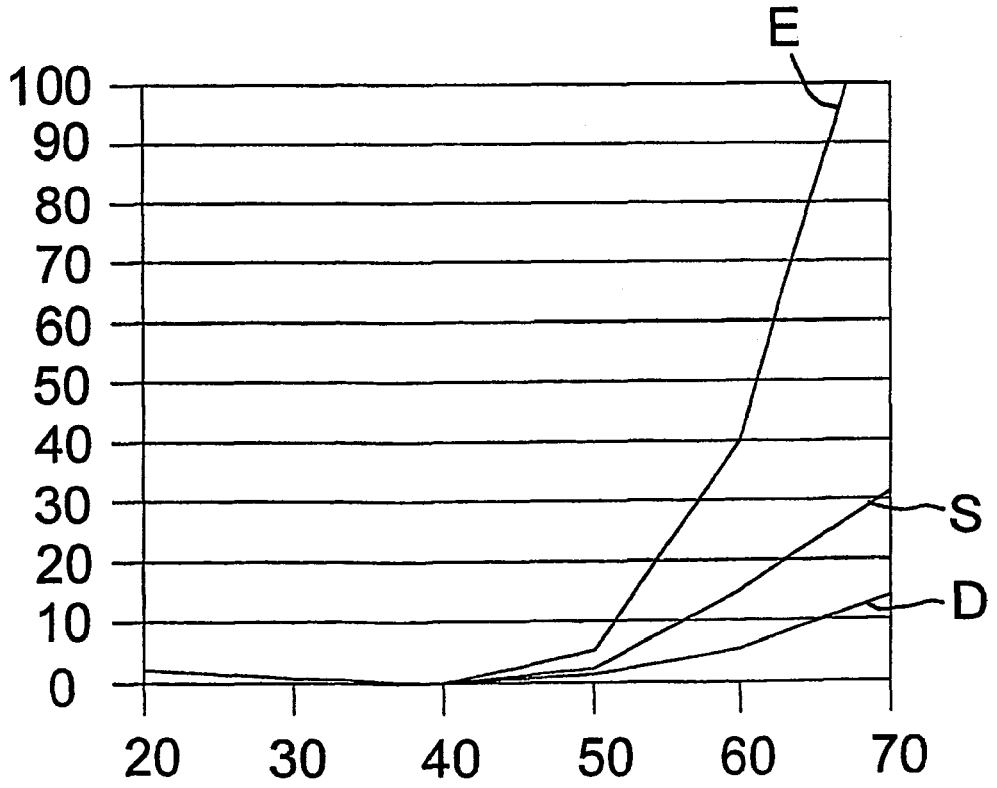

FIG. 4 is a similar graph to FIG. 3 but shows the effect of altering X1 in plugs within the invention. The axes of the graph shown in FIG. 4 represent the same parameters as those in FIG. 3 and the plot S of the illustrative plug 12 is also shown on FIG. 4. Plot D represents the performance of a plug within the scope of the invention but differing from the plug 10 in that the narrowest width X1 of the gap 34 is increased to 1.1 mm, the angles θ1 and θ2 remaining the same so that X2 equals 1.3 mm. It can be seen from FIG. 4 that the performance of the modified plug within the invention is an improvement over the plug 10. The plot E on FIG. 4 shows, for comparison purposes the performance of a plug similar to the plug A but with a spark gap with a constant width of 1.1 mm. The plot E indicates a poorer performance, indicating the importance of the taper gap 34.

The invention claimed is:

1. A spark plug comprising an electrically-insulating sleeve extending along a central axis of the plug, a first electrode mounted within the sleeve and having a tip projecting beyond said sleeve, an electrically-conducting shell surrounding said sleeve, and a second electrode mounted on and electrically-connected to said shell, the second electrode having a tip positioned in opposed-relationship to the tip of said first electrode, the tips of said first and second electrodes each having a spark surface facing the spark surface of the other electrode, the spark surfaces of the two electrodes defining a spark gap of the plug, characterized in that the spark surfaces of the first and the second electrodes are inclined at different angles relative to a plane extending normally of said central axis of the plug so that said spark gap varies in width along the length of the gap with the narrowest point of the gap being further from the connection between the second electrode and the shell than the other end of the gap, wherein the spark surface of the first electrode is inclined at an angle between 20 degrees and 55 degrees to a plane extending normally of the central axis of the plug.

2. A spark plug according to claim 1, characterized in that the increase in the width of the spark gap along its length is at least 0.05 mm.

3. A spark plug according to claim 1, characterized in that the narrowest width of the spark gap is between 0.6 and 1.3 mm.

4. A spark plug according to claim 1, characterized in that at least one of said electrodes is at least partly formed from a noble metal.

5. A spark plug comprising an electrically-insulating sleeve extending along a central axis of the plug, a first electrode mounted within the sleeve and having a tip projecting beyond said sleeve, an electrically-conducting shell surrounding said sleeve, and a second electrode mounted on and electrically-connected to said shell, the second electrode having a tip positioned in opposed-relationship to the tip of said first electrode, the tips of said first and second electrodes each having a spark surface facing the spark surface of the other electrode, the spark surfaces of the two electrodes defining a spark gap of the plug, characterized in that the spark surfaces of the first and the second electrodes are inclined at different angles relative to a plane extending normally of said central axis of the plug so that said spark gap varies in width along the length of the gap with the narrowest point of the gap being further from the connection between the second electrode and the shell than the other end of the gap;

wherein the increase in the width of the spark gap along its length is at least 0.05 mm, the narrowest width of the spark gap is between 0.6 and 1.3 mm, and the spark surface of the first electrode is inclined at an angle between 20 degrees and 55 degrees to a plane extending normally of the central axis of the plug.

6. A spark plug according to claim 5, characterized in that at least one of said electrodes is at least partly formed from a noble metal.

* * * * *